US007413483B2

(12) United States Patent
Karadimas et al.

(10) Patent No.: US 7,413,483 B2
(45) Date of Patent: Aug. 19, 2008

(54) METHOD AND APPARATUS FOR MULTI-PIN FEMALE CONNECTOR WITH REMOVABLE RECEPTACLES

(75) Inventors: Margaret Karadimas, Lisle, IL (US); Thomas Pravongviengkham, Elgin, IL (US)

(73) Assignee: GE Security, Inc., Austin, TX (US)

( * ) Notice: Subject to any disclaimer, the term of this patent is extended or adjusted under 35 U.S.C. 154(b) by 503 days.

(21) Appl. No.: 11/180,721

(22) Filed: Jul. 14, 2005

(65) Prior Publication Data

US 2007/0072490 A1 Mar. 29, 2007

(51) Int. Cl.
*H01R 13/432* (2006.01)

(52) U.S. Cl. ..... 439/747; 439/844

(58) Field of Classification Search ..... 439/744–749, 439/842, 844, 853

See application file for complete search history.

(56) References Cited

U.S. PATENT DOCUMENTS 4,887,980 A * 12/1989 Siegrist ..... 439/842
6,655,976 B1 * 12/2003 Shipe et al. ..... 439/328

* cited by examiner

*Primary Examiner*—Ross N Gushi
(74) *Attorney, Agent, or Firm*—Baker & Hostetler LLP

(57) ABSTRACT

A female connector head for a multi-line electrical connection is provided. The connector head includes a housing having proximal and distal faces. The housing defines a plurality of elongate lumens connecting the proximal and distal faces. Each lumen defines a receiving opening for a receptacle on the proximal face of the housing. Each lumen is configured to receive, enclose and hold a receptacle that is snap-fit into the lumen and defines at least one shoulder recess adapted to buttress a locking tab on a distal end of a receptacle. The housing further has at least two support pins extending from the distal face, and has at least two guiding pins extending normal from the distal face from two positions which are asymmetric about a center point of the distal face.

19 Claims, 5 Drawing Sheets

METHOD AND APPARATUS FOR MULTI-PIN FEMALE CONNECTOR WITH REMOVABLE RECEPTACLES

CROSS-REFERENCE TO RELATED APPLICATIONS

None.

FIELD OF THE INVENTION

The present invention relates generally to electronics and electrical communications hardware. More particularly, the present invention relates to a connector housing with female receptacles for mating to a corresponding male connector piece.

BACKGROUND OF THE INVENTION

Cable connectors are ubiquitous in today's technical environment. A myriad of connectors are used to couple cables and other signal carrying lines. The cables can carry multiple signals on multiple lines, and can be made of numerous materials, including copper wire, fiber-optics, gold-plated materials, etc. Furthermore, the signal lines carrying the signal through the cables can have a number of arrangements, where lines can be bundled or unbundled, multiplexed or non-multiplexed, and can carry a near limitless range of signals, carrying electrical pulses and currents which transmit data, encoded or un-encoded, voice communications, audio and video communications, etc.

Generally, for a given application, the cable and signal carrying lines have a unique property or structure dictated by the task at hand. This unique structure dictates that the connector heads for the cable be made of a similarly unique structure in order for the cable to function properly. An example is the home electrical socket, which includes a three-pin structure to carrying alternating current through a grounded connection. Computer cable connector heads often have an even higher number of pins for the multi-line signals that they carry. The heads for such devices also have a great variety of shapes so that they uniquely fit into the device they are connecting. For example, a serial port connector head has different shape than a parallel port connector head, so a user instantly understands which head is which and is able to easily differentiate between the two.

Assembling and making a connector head is therefore dictated by the nature of the signals carried in the cable, and the nature of the device to which the cable is connected. Often, it is necessary to build a connector head from scratch, or repair an existing connector head. Assembly, either from scratch or as part of a defined manufacturing process, can be cumbersome and expensive.

A particular kind of connector head is required to be used with a patient station apparatus that is used in a nurse call system for hospital and other medical facilities. The connector head must be practical to assemble and repair, and must be robust in case of failure. Often, with multi-line signal carrying devices and their associated connector heads, a single failure in one of the lines can render the entire apparatus useless. These failures can occur for any kind of connector head, including both male and female heads. The assembly and repair issues for a female head can be more difficult and expensive, depending on the device.

Accordingly, it is desirable to provide an apparatus for a female connector head for a multi-line signal carrying cable that is simple and robust, and can be easily repaired or fixed in case of failure. It is also desirable to provide a method of assembling and making such a female connector head for a multi-line signal carrying cable.

SUMMARY OF THE INVENTION

The foregoing needs are met, to a great extent, by the present invention, wherein in one aspect an apparatus is provided that in some embodiments provides a method and apparatus for a female connector head for a multi-line signal carrying cable.

In accordance with one embodiment aspect of the present invention, a female connector head for a multi-line electrical connection is provided. The connector head includes a housing having proximal and distal faces. The housing defines a plurality of elongate lumens connecting the proximal and distal faces. Each lumen defines a receiving opening on the proximal face of the housing. Each lumen also defines at least one shoulder recess facing the distal face of the housing. The housing further has at least two support pins extending from the distal face, and has at least two guiding pins extending normal from the distal face from two positions which are asymmetric about a center point of the distal face. The connector head also includes a plurality of receptacles. Each receptacle is adapted to snap-fit into any one of the elongate lumens by insertion though the lumen's receiving opening. Each receptacle has a distal end portion having at least one locking tab adapted to be buttressed against the at least one shoulder recess of a lumen when the receptacle is fully inserted in the lumen.

In accordance with another aspect of the present invention, a female connector head for a multi-line electrical connection is provided. The connector head includes a housing having proximal and distal faces. The housing defines a plurality of elongate lumens connecting the proximal and distal faces. Each lumen defines a receiving opening for a receptacle on the proximal face of the housing. Each lumen is configured to receive, enclose and hold a receptacle that is snap-fit into the lumen. Each lumen defines at least one shoulder recess adapted to buttress a locking tab on a distal end of a receptacle. The housing further has at least two support pins extending from the distal face, and has at least two guiding pins extending normal from the distal face from two positions which are asymmetric about a center point of the distal face.

In accordance with yet another aspect of the present invention, a method of assembling a female connector head for a multi-line electrical connection is provided. In the method, a plurality of receptacles is inserted through a corresponding plurality of receiving openings defined by a corresponding plurality of lumens defined by a housing having proximal and distal faces. Each lumen is configured to receive, enclose and hold one of the plurality of receptacles. Each of the plurality of receptacles is engaged to snap-fit into one of the plurality of lumens. Each lumen defines at least one shoulder recess adapted to buttress a locking tab on a distal end portion of a receptacle.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
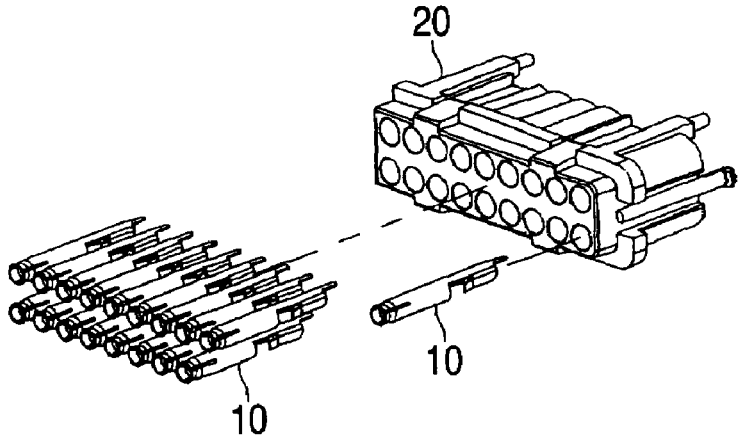
FIG. 1 is a perspective view illustrating a set of female receptacles aligned to be inserted into a connector housing according to one embodiment of the invention.

The invention will now be described with reference to the drawing figures, in which like reference numerals refer to like parts throughout. An embodiment in accordance with the present invention provides a female connector head having a housing into which a plurality of individual female receptacle units may be inserted. A receptacle is "snap-fit" into a receiving lumen in the connector housing. The connector head can be easily disassembled and/or repaired by removing the individual receptacles from the lumens.

Figure 2:
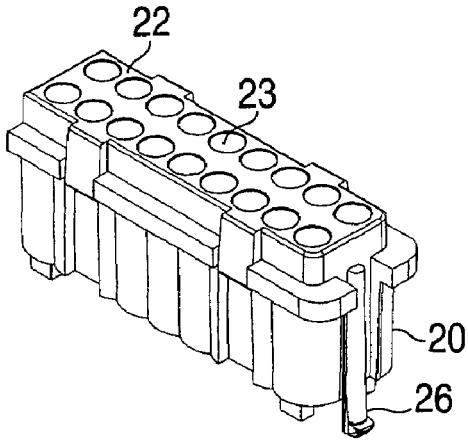
FIG. 2 is a perspective view of a connector housing showing the proximal face of the housing.

FIG. 1 is a perspective view illustrating a set of female receptacles 10 aligned to be inserted into a connector housing 20 according to one embodiment of the invention. The connector head is therefore made up of the housing 20 with one or more of the receptacles 10 inserted into the housing. FIG. 2 is a perspective view of the connector housing 20 showing the proximal face 22 of the housing 20. Housing 20 includes a number of receiving openings 23 on the proximal face 22. Each receiving opening 23 is one end of a lumen that runs through the housing 20 in a direction perpendicular to the proximal face 22. The lumens extend from the proximal face 22 to a distal face opposite the proximal face 22.

Figure 3:
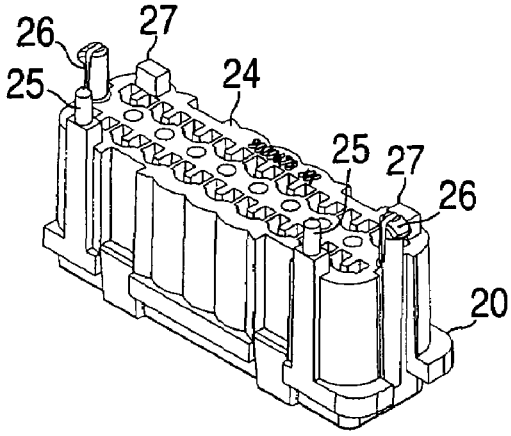
FIG. 3 is a perspective view of a connector housing showing the distal face of the housing.

FIG. 3 is a perspective view of connector housing 20 showing the distal face 24 of the housing. It is this distal face 24 that is adapted to be placed against a surface for attachment of the housing 20. As shown in both FIGS. 2 and 3, the connector housing 20 includes at least two guiding pins 25 and at least two locking pins 26. The guiding pins 25 are shaped and configured to guide and align the housing when it is attached or coupled to another surface, such as a printed circuit board (PCB). The guiding pins 25 would be inserted into corresponding receiving openings on the PCB. The locking pins 26 are shaped and configured to lock the connector housing 20 to a corresponding set of locking openings on a PCB. As can be seen in FIG. 3, the housing 20 includes one or more support pins or extensions 27 which are shorter than the guiding pins 25 so as to abut against a surface of a PCB when the housing is connected and locked to the PCB. By buttressing the housing 20 in this fashion, the support pins 27 support and stabilize the housing relative to the PCB.

Figure 4:
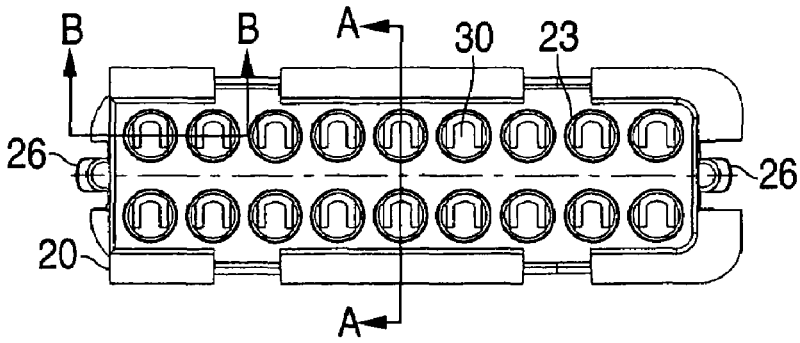
FIG. 4 is a plan view showing the proximal face of the housing.

FIG. 4 is a plan view showing the proximal face 22 of the housing 20 in greater detail. In the embodiment shown in FIG. 4, the lumens 30 are arranged in a set of two rows having nine lumens and openings 23 in each row. Alternative embodiments may include any number of rows having any number of lumens, or any other spatial arrangement of lumens, in rows, or not in rows, in accordance with the general principles of the present invention.

Figure 5:
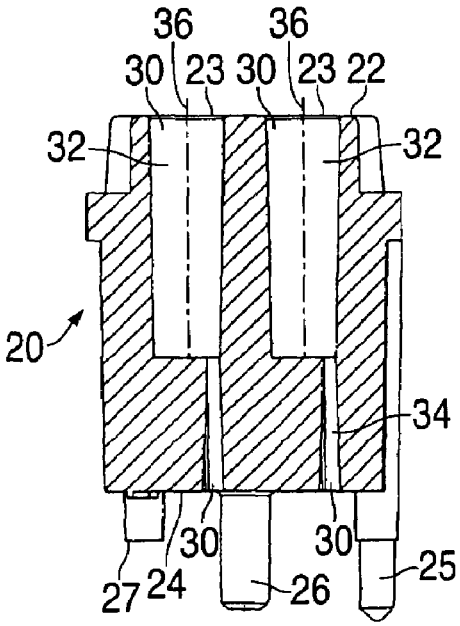
FIG. 5 is a cross-sectional view taken along the line A-A in FIG. 4.

FIG. 5 is a cross-sectional view taken along the line A-A in FIG. 4. FIG. 5 shows the lumens 30 where each receiving opening 23 is defined by a lumen 30 that extends through the housing 20 from its proximal face 22 to its distal face 24. As used herein, a "lumen" shall mean any passageway, space, path, enclosure or conduit that can have varying shapes and dimensions. The lumens 30 are shaped to have a generally cylindrical first, proximal portion 32 near the proximal face 22. Extending along the lumen 30 from the first proximal portion 32 towards the distal face 24 is a smaller, distal lumen portion 34 that is offset from the centerline 36 of the first proximal portion 32. FIG. 5 also shows the profiles of the locking pins 26, guiding pins 25, and support pins 27.

Figure 6:
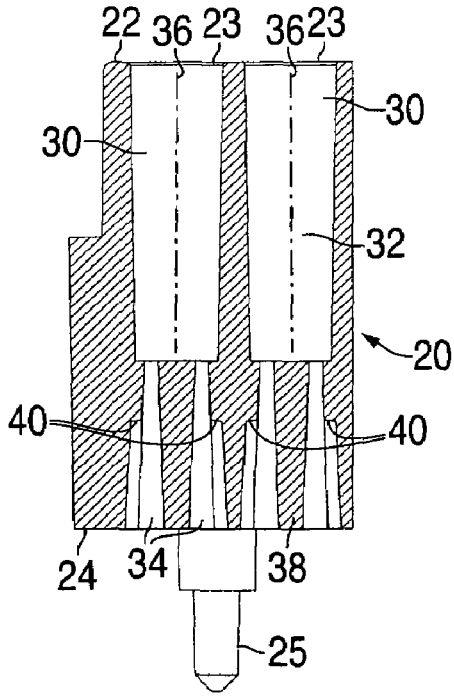
FIG. 6 is a cross-sectional view taken along the line B-B in FIG. 4.

FIG. 6 is a cross-sectional view taken along the line B-B in FIG. 4. FIG. 6 shows the shapes of the lumens 30 from another angle. The transverse cross-section taken parallel to the distal face 24 of the lower distal portion 34 of the lumen 30 is generally U-shaped, such that the distal portion 34 is wrapped around a central column 38 defined by the housing 20 as the distal portion 34 extends longitudinally along the length of lumen 30. The distal portion 34 also includes two shoulder recesses 40 or steps as defined by the shape of the housing 20 which defines the lumen 30. The recesses or shoulders 40 are formed when the transverse diameter of the distal portion 34 discontinuously increases as the lumen extends along towards the distal face 24.

Figure 7:
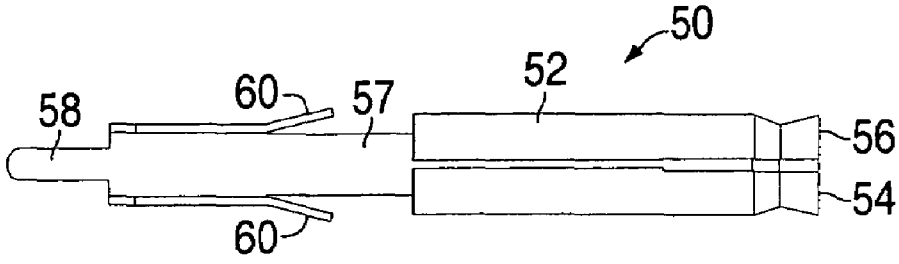
FIGS. 7, 8, and 9 illustrate a front, side, and back view, respectively, of a female receptacle according to one embodiment of the invention.
Figure 8:
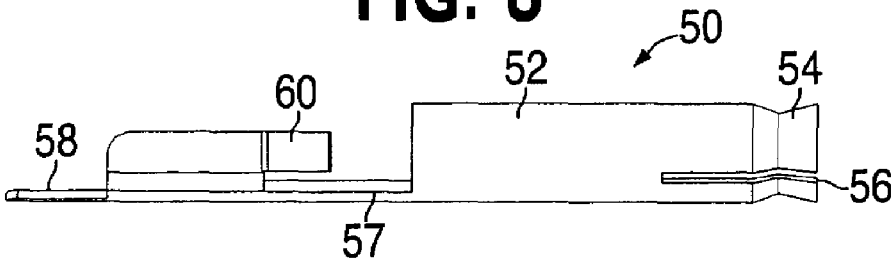
Figure 8A:
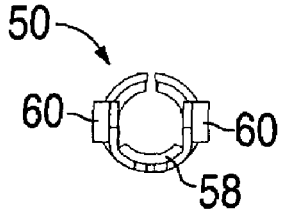
FIG. 8A is a top plan view of the female receptacle shown in FIGS. 7-9.
Figure 9:
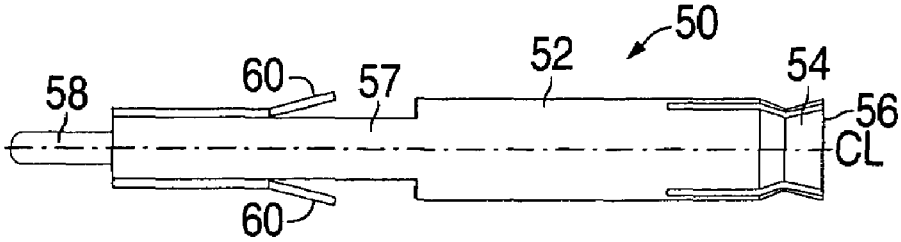

FIGS. 7, 8, and 9 illustrate a front, side, and back view, respectively, of a female receptacle 50 according to one embodiment of the invention. A "receptacle" is any body that is adapted to receive a male end of a plug, pin, insert, or extrusion that is used to transmit or relay a signal through a communications cable or medium. In the embodiment shown in FIGS. 7-9, the receptacle 50 has a proximal cylindrical shell portion 52 which has three spring leaf fingers 54 which surround a proximal opening 56 and allow for multiple insertions and removals of male pins. In one preferred embodiment, the male pin can have a diameter in the range of 0.090 to 0.100 inches. The receptacle 50 includes a distal end portion 57 that extends from the shell shaped proximal portion 52 and extends radially around only a portion of the centerline CL of the receptacle 50. The receptacle 50 includes a distal tail portion 58 that is adapted to wave soldered to a PCB. The receptacle 50 further includes a pair of locking tabs 60. Each of the locking tabs 60 are adapted to be buttressed against the at least one shoulder recess 40 of a lumen 30 when the receptacle 50 is fully inserted in the lumen 30. While the housing can be made primarily of a plastic of similar material, the receptacles 50 can be made primarily of a metal material, or other material combination that has sufficient electrical conductivity to allow for a signal to flow from a male pin inserted in the receptacle 50. FIG. 8A is a top plan view of the female receptacle shown in FIGS. 7-9.

Figure 10:
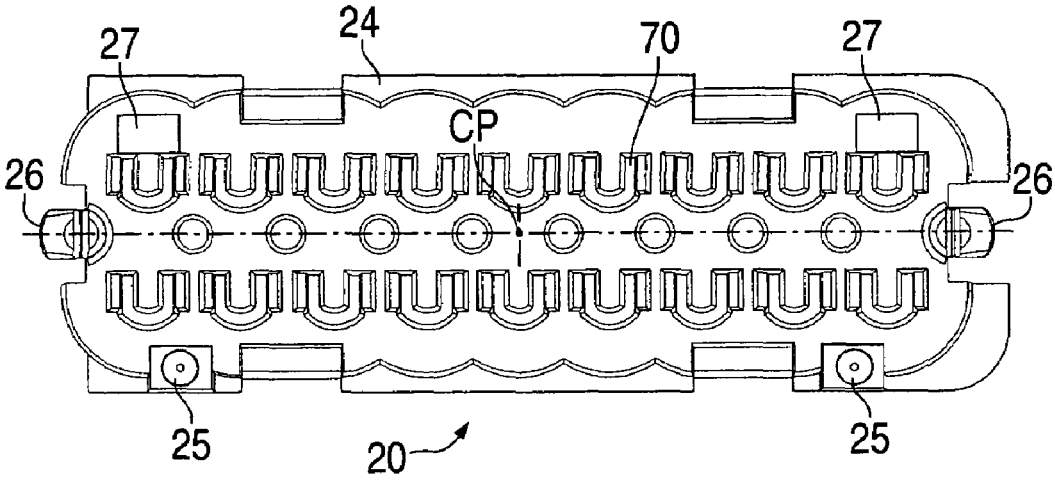
FIG. 10 is a plan view of the distal face of a connector housing.

FIG. 10 is a plan view of the distal face 24 of connector housing 20. As can be seen from FIG. 10, the two guiding pins 25 extending normal from the distal face 24 are located at two positions. On the plane of the distal face 24, these positions are asymmetric about a center point CP of the distal face 24. The positions may be symmetric about a plane that intersects the center point CP, but are not symmetric about the center point CP itself. This allows the housing and assembled connector head to inserted in only one direction or orientation when attached or coupled to another object by its distal face 24.

Figure 11:
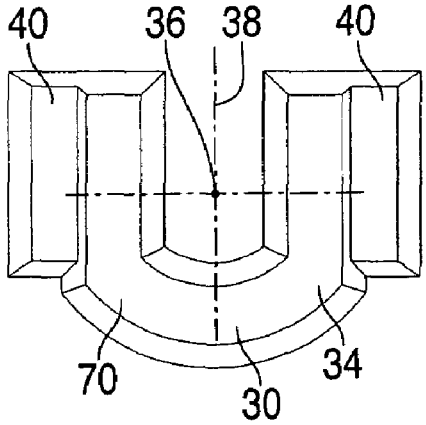
FIG. 11 is a is detail view of a part of the distal face of the housing shown in FIG. 10.

FIG. 11 is a is detail view of a part of the distal face 24 of the housing shown in FIG. 10, and shows a single distal opening 70 which terminates the lumen 30 and its distal portion 34 having recesses or shoulders 40. When the receptacle 50 is inserted into a lumen 30 of the housing 20, it is "snap-fit" to the housing 50 when the distal end portion 57 of the receptacle 50 is positioned in the distal end portion 34 of the lumen 30, such that the locking tabs 60 snap out and are buttressed against the shoulder recess 40 of a lumen 30 when the receptacle 50 is fully inserted in the lumen 30. By "snap-fit" it is meant that the pieces are substantially locked in position by the action of mechanical forces and pressures, and not by any chemical, thermal, fluid pressure or other bonding action. Once it is snap-fit, a receptacle 50 can be easily withdrawn from the housing 20 without having to completely dismantle or damage the device by insertion of a releasing tool or object into the distal lumen portion 34 to radial squeeze together the locking tabs 60 so they are no longer positioned on top of the shoulder recesses 40. This allows for easier disassembly or repair of the connector head.

Figure 12:
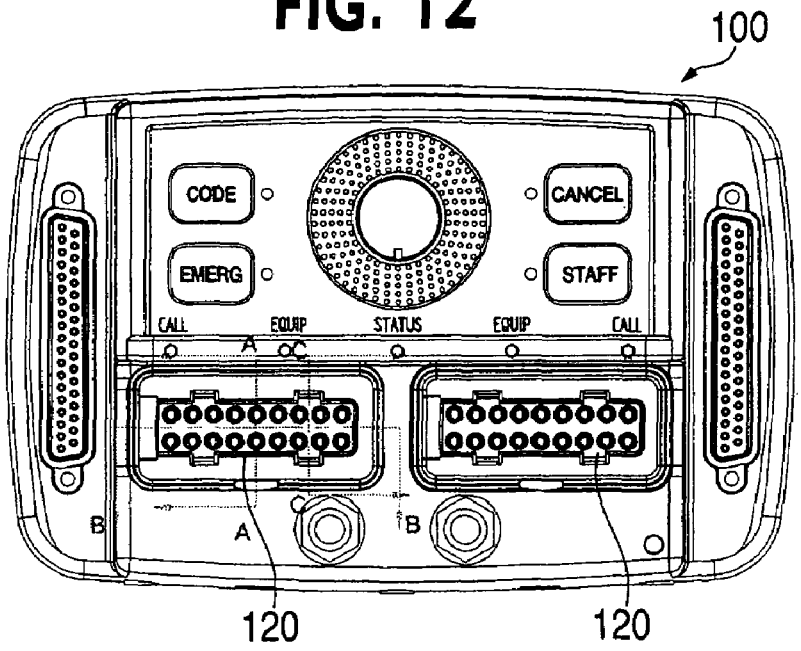
FIG. 12 is a plan view of an exemplary nurse call patient station incorporating the female connector head of the present invention.
Figure 12A:
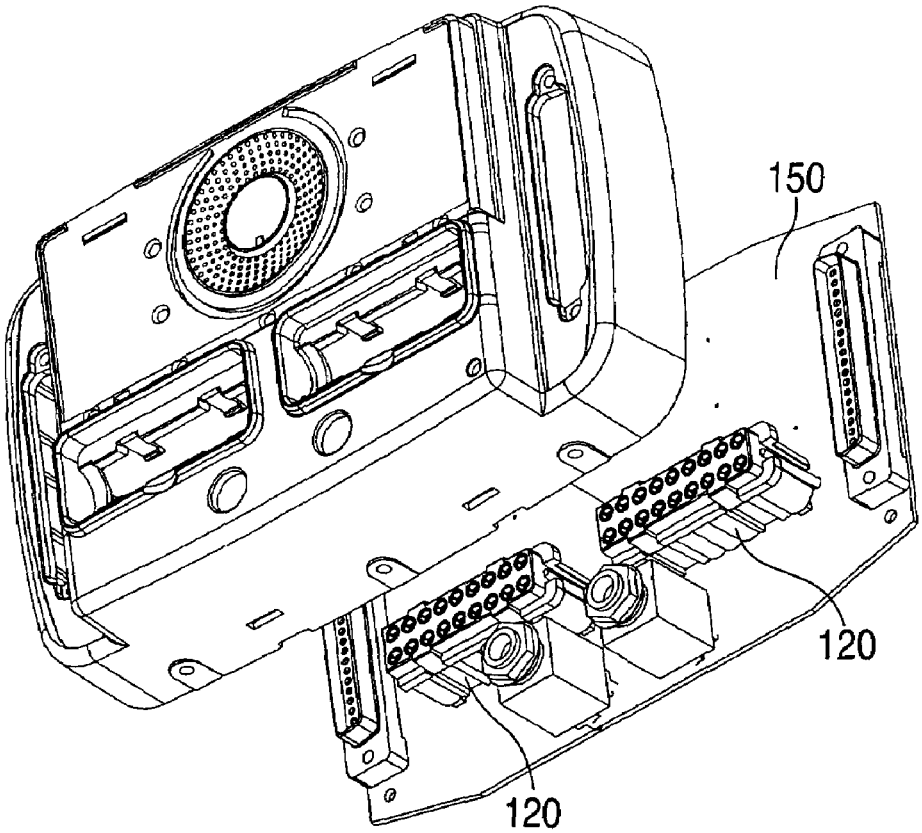
FIG. 12A is an exploded perspective view of the patient station of FIG. 12.

FIG. 12 is a plan view of an exemplary nurse call patient station 100 incorporating a female connector head 120 of the present invention. FIG. 12A is an exploded perspective view of the patient station of FIG. 12, showing how the connector heads 120 may be coupled to a PCB 150 as part of the patient station 100.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A female connector head for a multi-line electrical connection, comprising:

a housing having proximal and distal faces and defining a plurality of elongate lumens connecting the proximal and distal faces, each lumen defining a receiving opening on the proximal face of the housing, each lumen defining at least one shoulder recess facing the distal face of the housing, the housing further having at least two support pins extending from the distal face, and having at least two guiding pins extending normal from the distal face from two positions which are asymmetric about a center point of the distal face, and having at least two locking pins substantially parallel to the lumens and adapted to be snap-fit to a printed circuit board (PCB), and a plurality of receptacles, each receptacle adapted to snap-fit into any one of the elongate lumens by insertion though the lumen's receiving opening, each receptacle having a distal end portion having at least one locking tab adapted to be buttressed against the at least one shoulder recess of a lumen when the receptacle is fully inserted in the lumen.

2. The connector head of claim 1, wherein the plurality of lumens includes eighteen lumens, and the plurality of receptacles includes eighteen receptacles.

3. The connector of head of claim 2, wherein the plurality of lumens are arranged in two parallel rows of nine lumens each.

4. The connector head of claim 1, wherein each of the plurality of receptacles includes a distal tail adapted to be wave soldered to a circuit board.

5. The connector head of claim 4, wherein the at least two support pins include flat distal surfaces adapted to buttress the housing against the circuit board.

6. The connector head of claim 4, wherein the at least two guiding pins are adapted to be inserted into corresponding openings defined by the circuit board to immobilize the housing relative to the circuit board.

7. The connector head of claim 1, wherein the housing is primarily made of a plastic material, and the receptacles are primarily made of a metal material.

8. A female connector head for a multi-line electrical connection, comprising:

a housing having proximal and distal faces and defining a plurality of elongate lumens connecting the proximal and distal faces, each lumen defining a receiving opening for a receptacle on the proximal face of the housing, each lumen being configured to receive, enclose and hold a receptacle that is snap-fit into the lumen, each lumen defining at least one shoulder recess adapted to buttress a locking tab on a distal end of a receptacle, the housing further having at least two support pins extending from the distal face, and having at least two guiding pins extending normal from the distal face from two positions which are asymmetric about a center point of the distal face having at least two locking pins substantially parallel to the lumens and adapted to be snap-fit to a printed circuit board (PCB).

9. The connector head of claim 8, wherein the plurality of lumens includes eighteen lumens.

10. The connector of head of claim 9, wherein the plurality of lumens are arranged in two parallel rows of nine lumens each.

11. The connector head of claim 8, wherein the housing is configured to be attached to a circuit board, such that a distal tail on each of the plurality of receptacles is adapted to be wave soldered to the circuit board.

12. The connector head of claim 11, wherein the at least two support pins have flat distal surfaces adapted to buttress the housing against the circuit board.

13. The connector head of claim 11, wherein the at least two guiding pins are adapted to be inserted into corresponding openings defined by the circuit board to immobilize the housing relative to the circuit board.

14. The connector head of claim 8, wherein the housing is primarily made of a plastic material.

15. A method of assembling a female connector head for a multi-line electrical connection, comprising:

inserting a plurality of receptacles through a corresponding plurality of receiving openings defined by a corresponding plurality of lumens defined by a housing having proximal and distal faces, each lumen being configured to receive, enclose and hold one of the plurality of receptacles, engaging each of the plurality of receptacles to snap-fit into one of the plurality of lumens, each lumen defining at least one shoulder recess adapted to buttress a locking tab on a distal end portion of a receptacle, and inserting the housing onto a PCB with at least two locking pins adapted to be snap-fit onto the PCB, the housing further having at least two support pins extending from the distal face, the support pins buttressing the housing against a face of the PCB to support the housing, the housing further having at least two guiding pins extending normal from the distal face of the housing from two positions which are asymmetric about a center point of the distal face, the guiding pins being inserted into corresponding receiving openings defined by the face PCB.

16. The method of claim 15 further comprising the step of:

wave soldering a distal tail of a receptacle to the PCB to establish an electrical connection between the receptacle and the PCB.

17. The method of claim 15, wherein the plurality of lumens includes eighteen lumens, and the plurality of receptacles includes eighteen receptacles.

18. The method of claim 17, wherein the plurality of lumens are arranged in two parallel rows of nine lumens each.

19. The method of claim 15, wherein the housing is primarily made of a plastic material, and the receptacles are primarily made of a metal material.

* * * * *